United States Patent [19]

Matsuoka et al.

[11] Patent Number: 4,871,713

[45] **Date of Patent: * Oct. 3, 1989**

[54] HEAT-SENSITIVE RECORDING MATERIAL

[75] Inventors: Katsumi Matsuoka; Kensuke Ikeda; Ken Iwakura, all of Shizuoka, Japan

[73] Assignee: Fuji Photo Film Co., Ltd., Kanagawa, Japan

[ * ] Notice: The portion of the term of this patent subsequent to Dec. 5, 1988 has been disclaimed.

[21] Appl. No.: 168,117

[22] Filed: Mar. 14, 1988

[30] Foreign Application Priority Data

Mar. 12, 1987 [JP] Japan ..... 67-57832

[51] Int. Cl.[4] ..... B41M 5/18

[52] U.S. Cl. ..... 503/209; 428/342; 428/913; 428/914; 503/211; 503/225

[58] Field of Search ..... 427/150–152; 428/913, 914; 503/210–212, 208, 209, 215, 216, 217, 225

[56] References Cited

U.S. PATENT DOCUMENTS 4,262,938 4/1981 Yamaguchi et al. ..... 503/211

FOREIGN PATENT DOCUMENTS 0021294 2/1985 Japan ..... 503/211

*Primary Examiner*—Bruce H. Hess

*Attorney, Agent, or Firm*—Sughrue, Mion, Zinn, Macpeak & Seas

[57] ABSTRACT

A heat-sensitive recording material which produces a developed color image with improved light fastness upon application of thermal energy comprising:

(1) an electron-donating colorless dye, (2) an electron-accepting compound, and (3) a nickel compound represented by formula (I):

(I)

wherein $R_1$ and $R_2$ each represents an aryl group, or they may combine with each other; L represents an organic ligand which forms a complex salt by connecting to the nickel ion via its hetero atom; and n represents an integer of 0, 1 or 2.

6 Claims, No Drawings

HEAT-SENSITIVE RECORDING MATERIAL

FIELD OF THE INVENTION

The present invention relates to a heat-sensitive recording material, and, more particularly, to a heat-sensitive recording material which can produce a developed color image with improved keeping stability.

BACKGROUND OF THE INVENTION

Recording materials which utilize electron-donating colorless dyes and electron-accepting compounds are well known Examples of such include pressure-sensitive recording paper, heat-sensitive paper, photo- and pressure-sensitive recording paper, electro thermo-recording paper, and the like. These recording materials are described in detail, e.g., in British Pat. No. 2,140,449, U.S. Pat. Nos. 4,480,052 and 4,436,920, Japanese Patent Publication No. 23922/85, Japanese Patent Application (OPI) Nos. 179836/82, 123556/85 and 123557/85 (the term "OPI" as used herein means an "unexamined published Japanese patent application"), and so on.

A heat-sensitive recording material must at least have the following properties: (1) it must produce a developed color images of sufficiently high density, (2) it must not cause coloration during storage before use, and (3) it must ensure sufficient fastness to the developed color images. However, heat-sensitive recording materials which adequately meet all of these requirements have not yet been obtained.

Addition of a benzotriazole compound, a hindered phenol compound or the like has been employed in order to 5 improve the fastness of developed color images. However, the improvement in fastness achieved by the addition of such a compound to a heat-sensitive recording material is still insufficient.

SUMMARY OF THE INVENTION

Therefore, an object of the present invention is to provide a heat-sensitive recording material which produces developed color images with improved fastness.

The above-described object has been met by a heat-sensitive recording material which comprises:

(1) an electron-donating colorless dye, (2) an electron-accepting compound, and (3) a nickel compound represented by formula (I):

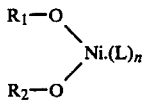

(I)

wherein $R_1$ and $R_2$ each represents an aryl group, or they may combine with each other; Li represents an organic ligand which forms a complex salt by connecting to the nickel ion via its hetero atom; and n represents an integer of 0, 1 or 2.

DETAILED DESCRIPTION OF THE INVENTION $R_1$ and $R_2$ each represents preferably

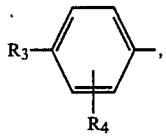

wherein $R_3$ and $R_4$ each represents a hydrogen atom, an alkyl group, an alkoxy group, an aryl group, a halogen atom, a cyano group, or a nitro group. Of these substituent groups, a hydrogen atom, an alkyl group having 1 to 12 carbon atoms, an alkoxy group having 1 to 10 carbon atoms, a phenyl group or a chlorine atom are preferred over others as $R_3$ and $R_4$.

Of the nickel compounds represented by formula (I), those having a solubility of 5 or more, preferably 10 or more, in toluene are preferred over others. The term solubility used in he present invention refers to the mass of a solute dissolved in 100 g of the solution at 25° C.

As for the group formed by connecting $R_1$ to $R_2$, those represented by formula (II) are preferred:

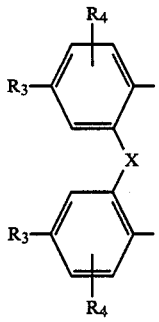

(II)

wherein $R_3$ and $R_4$ have the same meanings as described above, and X represents $—SO_m—$, $—CHR_5—$, or —CO— (wherein $R_5$ represents a hydrogen atom or an alkyl group, and m represents 0, 1 or 2).

Of the groups represented by formula (II), those containing a hydrogen atom, an alkyl group having 1 to 12 carbon atoms or an alkoxy group having 1 to 10 carbon atoms as $R_3$ and $R_4$, and containing ≦S— or $—CHR_5—$ as X are particularly preferred.

Li represents an organic ligand which forms a complex salt by connecting to the nickel ion via its hetero atom. Suitable examples of such a hetero atom include nitrogen, oxygen, sulfur, selenium and phosphorus. Of these aoms, nitrogen is preferred over others.

Upon complexation, it is to be desired that the ligand should be attached to the nickel ion via nitrogen atom(s) found in a mono , bi- or tri dentate molecule, e.g., a primary, secondary or tertiary amine, a substituted or unsubstituted imine, a nitro compound, an oxyimine, a hydrazine or a hydrazone.

Suitable examples of the ligands containing nitrogen atom(s) include aliphatic, alicylic, aromatic, aryl-substituted aliphatic and heterocylic amines. Representatives of aliphatic alicylic and aryl-substituted aliphatic nitrogen-containing ligands are, e.g., alkylamines having 1 to 18 carbon atoms, such as methylamine, ethylamine, n-propylamine, isopropylamine, n-butylamine, n-hexylamine, n-octylamine, 1,4-butylene-diamine, t-octylamine, n-decylamine, n-dodecylamine, octadecylamine and the like; alicyclic amines such as cyclopentylamine, cyclohexylamine and the like; benzylamine, 4-methylbenzylamine, α- and β-phenyl-ethylamine, and so on.

Suitable examples of secondary heterocylic ligands which contain nitrogen atom(s) as hetero atoms include pyrrolidine, piperidine, pipecoline, morpholine, thiomorpholine, imidazoline, indoline, benzomorpholine, benzimidazoline, tetrahydroquinoline, and 2,2,4-trimethyltetrahydroqinoline.

Suitable examples of aromatic amines include aniline; substituted anilines such as 2,3 or 4-dimethylaniline, chloroaniline, methoxyaniline, dichloroaniline and so on; N-alkyl- or N,N-dialkylanilines, such as N-methylaniline, N-ethylaniline, N,N-dimethylaniline, N,N-diethylaniline and so on; and diphenylamine, 4,4'-di-aminodiphenyl ether, 4,4'-diaminodiphenyl sulfide, 4,4'-diaminodiphenylsulfone, 4,4'-diaminodiphenylalkanes like 4,4'-diaminodiphenylmethane and 4,4'-diaminodiphenylethane, and 4,4'-diaminoazobenzene.

The heterocyclic amines which contain nitrogen atom(s) as hetero atoms may contain 5- or 6-membered aromatic hetero rings which may be substituted with an alkyl group having 1 to 18, preferably 1 to 4, carbon atoms, an alkoxy group having 1 to 4 carbon atoms, a cyano group, a hydroxyl group, a vinyl group, a phenyl group, an acyl group having 1 to 4 carbon atoms, or an amino group, and/or may be fused together with a benzene ring which may be substituted with, e.g., a halogen atom, an alkyl group having 1 to 4 carbon atoms, or an alkoxy group having 1 to 4 carbon atoms.

Specific examples of the ligands of the abovedescribed kind include pyrrole, 2,4-dimethylpyrrole, pyrrolidone, imidazole, 1-methylimidazole, 2-methylimidazole, 1-vinylimidazole, 2-phenyli,midazole, pyrazole, 3,4-dimethyl-5-pyrazolone, triazole, pyridine, α-, β- or γ-picoline, lutidine, collidines, parvoline, conyrines, methoxypyridines, aminopyridines (e.g., 3-aminopyridine, 2,3-diaminopyridine and 2,6-diaminopyridine), 4-formylpyridine, 4-cyanopyridine, pyrimidine, pyrazines, triazine, melamine, guanamines, amarin, quinoline, 2-ethylquinoline, isoquinoline, quinaldine, quinazoline, quinoxaline, phthalazine, cinnoline, indolizine, indoles (e.g., 2-methylindole and 2-phenylindole), benzimidazole, 2-methylbenzimidazole, 2-stearylbenzimidazole, 2-aminobenzimidazole, benzoxazole, benzothiazole, 2-thiobenzothiazole, 2-aminobenzothiazole, benzotriazole, carbazole, acridine, phenazine, antipyrine, diguanamine, guanidine, bipyridyl, 2,6-(di-2-pyridyl)pyridine (terpyridine), phenanthridine, phenanthroline, and dipyridyl ketone.

The nitrogen-containing ligands can be bidentate bifunctional) and upward. Specific examples of such ligands include alkylenediamines like ethylenediamine and propylenediamine, phenylenediamines, dialkylenetriamines, and triaminoalkanes. More specifically, the dialkylenetriamines include, e.g., diethylenetriamine, monoethylene/monopropylenetriamine, dirpropylenetriamine, and N-alkyl derivatives thereof. Triaminoalkanes include, e.g., α-, β- and γ-triaminopropanes, α-, β- and γ-triaminobutane, and α-, and γ-diamino-β-(aminoethyl)propane. Two or more nitrogen atoms attached to the metal, and two or more carbon atoms attached to the nitrogen atoms can constitute one hetero ring, or one heterocyclic system. Representatives of such bidentate nitrogen-containing ligands are piperazine, imidazoline, and diazobicyclo[2,2,2]octane.

Other compounds preferred as nitrogen-containing ligands include hydrazines such as hydrazine, alkylhydrazines having 1 to 5 carbon atoms, arylhydrazines (e.g., phenylhydrazine), etc.; hydrazones such as acetone hydrazone, acetophenone hydrazone, etc.; hydrazides such as acetohydrazide, benzohydrazide, etc.; hydroxylamine; amidines like formamidine; amides such as formamide, dimethylformamide, tetramethylurea, acetamide, benzamide, etc.; and oximes such as acetoaldoxime, acetoxime, etc.

As discussed above, the ligand Li in the nickel complex compound of the present invention can coordinate via oxygen, sulfur or phosphorus atoms.

Preferred examples of ligands to be coordinated with the metal via an oxygen atom or a sulfur atom include carbonyl compounds such as benzophenone, acetyl acetone, pyrone, etc.; amine oxides; phosphine oxides like triphenylphosphine oxide; urea; thiocarbonyl compounds like thiourea; and their derivatives, such as 4,4'-bis(dimethylamino)benzophenone (Michler's ketone), etc. In addition, suitable examples of ligands containing a sulfur atom include mercaptanes like 2-mercaptobenzothiazole, and thiones like 1,3-dimethylimidazoline-2-thione. Suitable examples of organic ligands to be coordinated with the metal via a phosphorus atom include phosphines such as triphenyl phosphine, etc.

Specific examples of the compounds of the present invention are illustrated below. However, the invention should not be construed as being limited to the following examples.

(1)

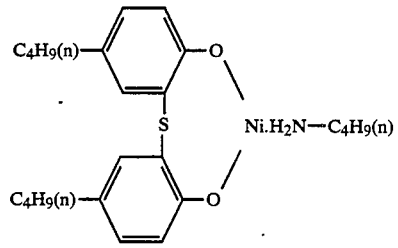

(2)

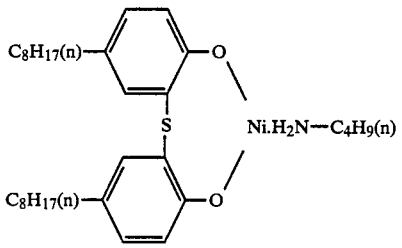

(3)

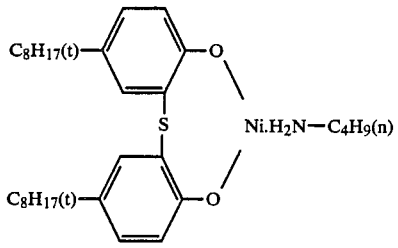

-continued
(4)
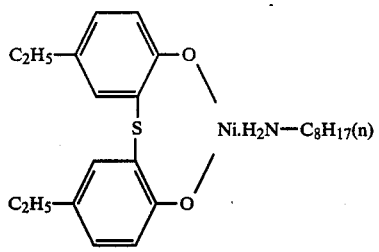
(5)
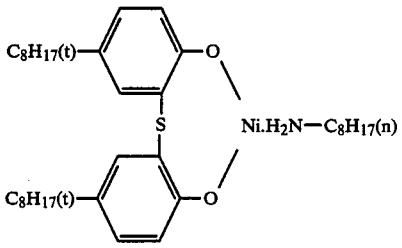
(6)
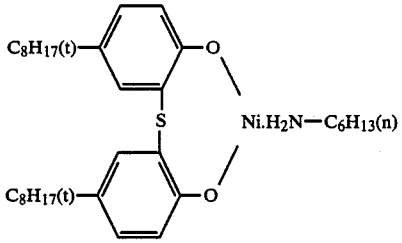
(7)
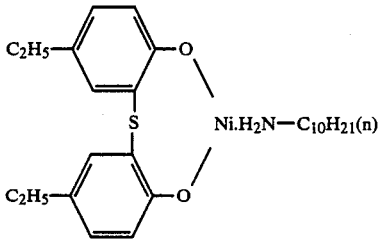
(8)
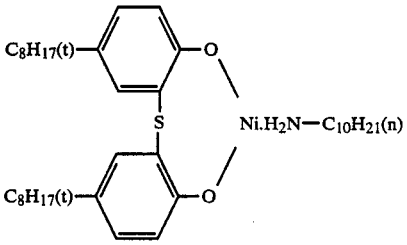
(9)
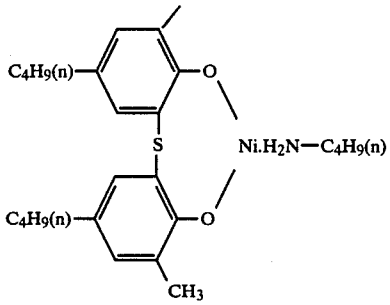
-continued
(10)
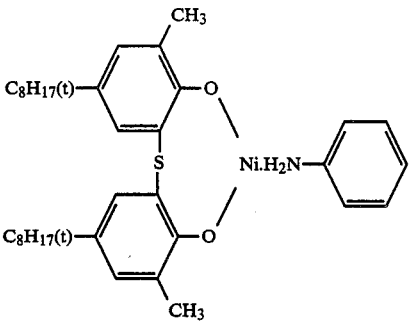
(11)
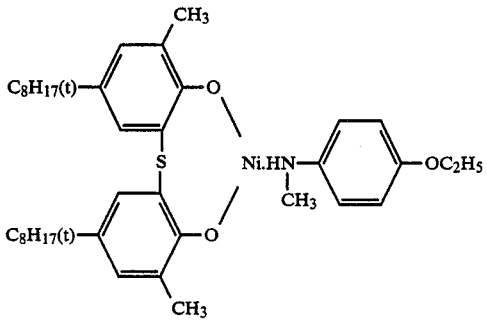
(12)
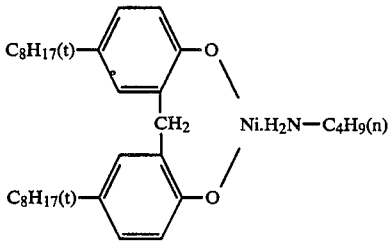
(13)
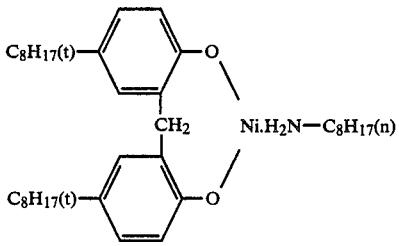
(14)
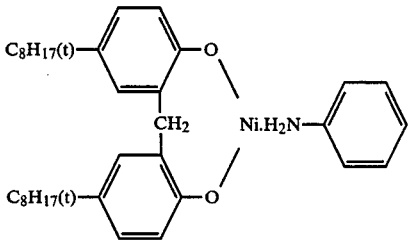

-continued (15)

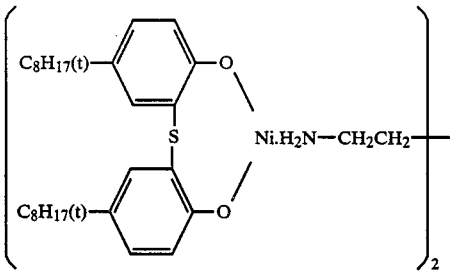

(16)

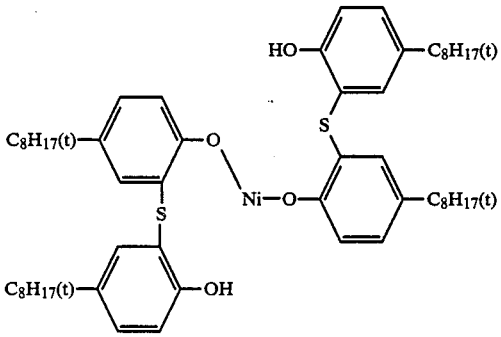

(17)

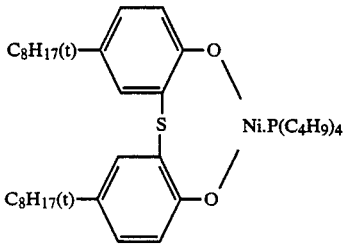

The nickel compound is used in a proportion of 5 to 200 wt % preferably 10 to 100 wt %, to an electron-donating colorless dye.

Examples of electron-donating colorless dyes which can be used in the present invention include triarylmethane phthalide compounds, xanthene compounds including fluoran compounds, and rhodamine lactam compounds, phenothiazine compounds, indolyl phthalide compounds, diphenylmethane compounds including leuco auramine compounds, triphenylmethane compounds, triazene compounds, fluorene compounds, spiropyran compounds, and so on. Of these colorless dyes, those capable of showing a black hue when used alone or as a mixture of two thereof are preferred over others.

Specific examples of phthalide compounds are described in U.S. Re. Pat. No. 23,024, U.S. Pat. Nos. 3,491,111, 3,491,112, 3,491,116 and 3,509,174; those of fluoran compounds in U.S. Pat. Nos. 3,624,107, 3,627,787, 3,641,011, 3,462,828, 3,681,390, 3,920,510, and 3,959,571; those of spirodipyran compounds in U.S. Pat. No. 3,971,808; color developing compounds of pyridine and pyrazine types in U.S. Pat. Nos. 3,775,424, 3,853,869, and 4,246,318; and those of fluorene compounds in Japanese Patent Application No. 240989/86.

Illustrative examples of these colorless dyes are given below. Triarylmethane compounds include 3,3-bis(p-dimethylaminophenyl)-6-dimethylaminophthalide (i.e., Crystal Violet lactone), 3,3-bis(p-dimethylaminophenyl)phthalide, 3-(2-ethoxy-4-diethylaminophenyl)-3-(1-ethyl-2-methylindole-3-yl)phthalide, 3-(2-ethoxy-4-diethylaminophenyl)-3-(1-octyl-2-methylindole-3-yl)phthalide, etc.

Diphenylmethane compounds include 4,4'-bis-dimethylaminobenzhydrine benzyl ether, N-halophenylleucoauramine, N-2,4,5-trichlorphenyl-leucoaruamine, etc.

Xanthene compounds include Rhodamine-B-anilinolactam, Rhodamine (p-nitroanilino)lactam, 2-(dibenzylamino)fluoran, 2-phenylamino-6-diethylamino-fluoran, 2-(o-chloroanilino)-6-diethylamino-fluoran, 2-(3,4-dichloroanilino)-6-diethylaminofluoran, 2-anilino-3-methyl 6-piperidinofluoran, 2-phenyl-6-diethylaminofluoran, 3,6-bis(diphenylamino)fluoran, etc.

Thiazine compounds include benzoyl Leuco Methylene Blue, p-nitrobenzyl Leuco Methylene Blue, etc.

Spiropyran compounds include 3-methyl-spiro-dinaphthopyran, 3-ethyl-spiro-dinaphthopyran, 3,3'-dichlorospiro-dinaphthopyran, 3-benzyl-spiro-dinaphthopyran, 3-methyl-naphtho-(3-methoxybenzo)spiropyran, 3-propyl-spirodibenzopyran, etc.

These compounds are used alone or as a mixture of two or more thereof.

Of the above-cited compounds, triarylmethane compounds (e.g., Crystal Violet Lactone) and xanthene compounds are preferred over others, because many of them hardly cause fog and can provide high density of developed color.

As more preferred examples of such colorless dyes, mention may be made of xanthene compounds represented by the following formula (III):

(III)

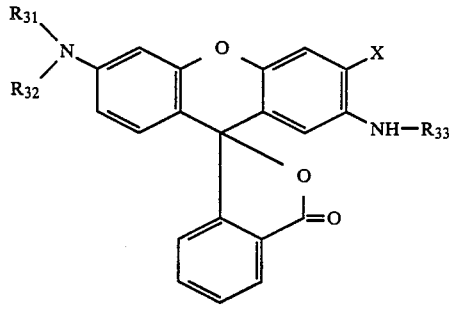

wherein $R_{31}$ and $R_{32}$, which may be the same or different, each represents a straight chain or branched or cyclic, substituted or unsubstituted, alkyl group having 1 to 10 carbon atoms, or a 5- to 7-membered heterocyclic ring; $R_{33}$ represents an aryl group, preferably one which has 6 to 20 carbon atoms, particularly preferably a phenyl or a substituted phenyl group (the substituent group for the phenyl group preferably includes ah alkyl group having 1 to 10 carbon atoms); and X represents a hydrogen atom, an alkyl group having 1 to 10 carbon atoms, an alkoxy group, a phenyl group or a halogen atom.

Suitable examples of the substituent groups for the alkyl groups of $R_{31}$ and $R_{32}$ include an alkyl group, an alkoxy group, an aryloxy group, a halogen atom, a hetero ring, an aryl group, a hydroxy group, etc.

Specific examples of these compounds of formula (III) are given below. However, the present invention should not be construed as being limited to these examples.

Such compounds include 2-anilino-3-methyl-6-dimethylaminofluoran, 2-anilino-3-methyl-6-N-methyl-N-ethylaminofluoran, 2 anilino-3-methyl-6-N-methyl-N-

(isopropyl)aminofluoran, 2-anilino-3-methyl 6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(iso-propyl)aminofluoran, 2-anilino-3-chloro-6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2 (p-methylanilino)-3-methyl-6-dimethylaminofluoran, 2-(p-methylanilino)-3-methyl-6-diethylaminofluoran, 2-(p-methylanilino)-3-methyl-6-N-methyl-N-(iso-propyl)aminofluoran, 2-(p-methylmethylanilino)-3 methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl N-ethylaminofluoran, 2-(p-methylanilino)-3-chloro-6-N-methyl-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, 2,2-bis[4 -{6'-(N-ethyl-N-isoamylamino)-3'-methylspiro[phthalido-3,9'-xanthene]-2'ylamino}phenyl]propane, and so on.

These compounds, though can be safely used alone, may be used as a mixture of two or more thereof with the intention of controlling the tone of the color to be developed and inhibiting the discoloration of the developed color image.

Suitable examples of the electron-accepting compounds which can be used in the present invention include phenol derivatives, bisphenol derivatives, hydroxybenzoic acid derivatives, salicylic acid derivatives, and complex salts of metal compounds. Preferred ones thereof are represented by the following formulae (IV) to (VII).

Formula (IV) is shown below:

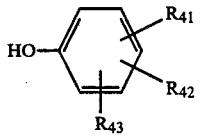

(IV)

wherein $R_{41}$ and $R_{42}$, which may be the same or different, each represents a hydrogen atom, an alkyl group, an alkoxy group, an aryl group, an arylsulfonyl group, an alkoxycarbonyl group, or a halogen atom; and $R_{43}$ represents a hydrogen atom, or a group of the following formula (VIII):

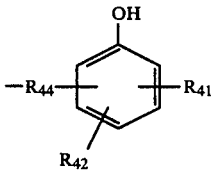

(VIII)

wherein $R_{41}$ and $R_{42}$ have the same meaning as those in the formula (IV), respectively; and $R_{44}$ represents a divalent group having 1 to 12 carbon atoms, or $—SO_2$.

Of the compounds represented by formula (IV), those containing a hydrogen atom as $R_{43}$, and a hydrogen atom or an alkoxycarbonyl group as $R_{41}$ and $R_{42}$, and those containing as $R_{43}$ the group of formula (VIII) in which $R_{44}$ represents an alkylene group having 3 to 12 carbon atoms a cycloalkylene group having 5 to 7 carbon atoms, an aralkylene group having 8 to 12 carbon atoms, or $—SO_2$ are preferred over others.

The alkyl group in formulae (IV) and (VIII) includes saturated, unsaturated and cyclic ones, which may be substituted with an aryl group, an alkoxy group, an aryloxy group, a halogen atom, a cyano group, or so on.

Specific examples of the compounds represented by formula (IV) include 4-phenylphenol, bisphenol sulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl 4-hydroxyphenylsulfone, hexyl-4-hydroxybenzoate, 2,2'-dihydroxybiphenyl, 2,2-bis(4-hydroxyphenyl)propane, 4,4'isopylidenebis(2-methylphenol), 1,1-bis(3-chloro-4-hydroxyphenyl)cyclohexane, 1,1-bis(3-chloro-4-hydroxyphenyl)-2-ethylbutane, 4,4'-secondary-isooctylidenediphenol, 4,4'-sec-butylidenediphenol, 4-p-methylphenylphenol, 4,4'-isopentylidenediphenol, 4,4'-methylcyclohexylidehediphenol, 4,4'-dihydroxydiphenylsulfide, 1,4-bis(4'hydroxycumyl)benzene, 1,3-bis(4'-hydroxycumyl)benzene, 4,4'-thiobis(6-tert-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, 2,2',4,4'-tetrahydroxybenzophenone, dimethyl 4-hydroxyphthalate, methyl-4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenetyl 4-hydroxybenzoate, 4-hydroxy-2',4'-dimethyldiphenylsulfone, β-phenetylorsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methybenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, etc.

Formulae (V) and (VI) are shown below:

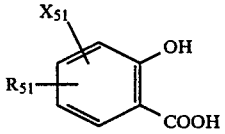

(V)

-continued

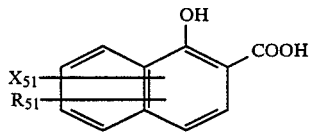

(VI)

wherein $R_{51}$ represents an alkyl group, an alkoxy group, an acyl group, an acylamino group or an aryl group, and $X_{51}$ represents a hydrogen atom, an alkyl group, an alkoxy group or a halogen atom.

In formulae (V) and (VI), the alkyl groups therein include saturated, unsaturated, and cyclic ones, which each may be substituted with an aryl group, an alkoxy group, an aryloxy group, a halogen atom, an acylamino group, an aminocarbonyl group, a cyano group or so on, while the aryl group therein includes phenyl, naphthyl and aromatic heterocyclic groups, which each may be substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group or so on.

Of the above-described substituents represented by $R_{51}$, alkyl groups having 1 to 30 carbon atoms, alkoxy groups, acyl group, acylamino groups, and aryl groups having 6 to 24 carbon atoms are preferred over others. As for the substituent groups represented by $X_{51}$, a hydrogen atom, alkyl groups having 1 to 9 Carbon atoms, alkoxy groups having 1 to 5 carbon atoms, a chlorine atom and a fluorine atom are preferred.

These substituents represented by $R_{51}$ may further have a substituent group, such as an aryl group, an alkoxy group, a halogen atom, an aryloxy group, an acylamino group, a phenyl group, or a substituted carbamoyl group. The preferred substituent group of those represented by $R_{51}$ is an alkoxy group, especially preferably an aryloxyalkoxy group represented by the formula:

$$-O-(C_mH_{2m}-O)_n-Ar$$

wherein m represents an integer of 1 to 10, particularly preferably 2 to 4; n represents an integer of 1 to 3, preferably 1 or 2; and Ar represents an aryl group (preferably having 6 to 22 carbon atoms), which may be substituted with one or more of a group selected from among alkyl groups having 1 to 12 carbon atoms, aralkyl groups having 7 to 16 carbon atoms, alkoxy groups having 1 to 12 carbon atoms, halogen atoms, phenyl groups, alkoxycarbonyl groups, etc.

Specific examples of preferred aryl groups for Ar include a phenyl group, a tolyl group, an ethylphenyl group, a propylphenyl group, a butylphenyl group, a cyclohexylphenyl group, an octylphenyl group, a nonylphenyl group, a dodecylphenyl group, a benzylphenyl group, a phenetylphenyl group, a cumylphenyl group, a xylyl group, a diphenethylphenyl group, a methoxyphenyl group, an ethoxyphenyl group, a benzyloxyphenyl group, an octyloxyphenyl group, a dodecyloxyphenyl group, a chlorophenyl group, a fluorophenyl group, a phenylphenyl group, a hexyloxycarbonylphenyl group, a benzyloxycarbonylphenyl group, a dodecyloxycarbonylphenyl group, a naphthyl group, a methylnaphthyl group, a chloronaphthyl group and the like.

In formula (V), the substituent group represented by $R_{51}$ may be situated at the o-, m- or p-position with respect to the COOH group. In particular, the p-position is preferred.

Specific examples of the compounds represented by formulae (V) and (IV) include 4-β-p-methoxyphenoxyethoxysalicylic acid, 4-β-p-ethoxyphenoxyethoxysalicylic acid, 4-β-p-benzyloxyphenoxyethoxysalicylic acid, 4-β-p-dodecyloxyphenoxyethoxysalicylic acid, 4-β-p-chlorophenoxyethoxysalicylic acid, 4-β-p-phenylphenoxyethoxysalicylic acid, 4-β-p-cyclohexylphenoxyethoxysalicylic acid, 4-β-p-benzyloxycarbonylphenoxyethoxysalicylic acid, 4-β-p-dodecyloxycarbonylphenoxyethoxysalicylic acid, 4-β-naphthyl(2)-oxyethoxysalicylic acid, 4-β-phenoxyethoxysalicylic acid, 4-(4-phenoxybutoxy)salicylic acid, 4-(6-phenoxyhexyloxy)salicylic acid, 4-(5-phenoxyamyloxy)salicylic acid, 4-(8-phenoxyoctyloxy)salicylic acid, 4-(10-phenoxydecyloxy)salicylic acid, 4-β-p-tolyloxyethoxysalicylic acid, 4-β-m-tolyloxyethoxysalicylic acid, 4-β-p-ethylphenoxyethoxysalicylic acid, 4-β-p-isopropylphenoxyethoxysalicylic acid, 4-β-p-t-butylphenoxyethoxysalicylic acid, 4-β-p-cyclohexylphenoxyethoxysalicylic acid, 4-β-p-benzylphenoxyethoxysalicylic acid, 4-β-o-methoxyphenoxyethoxysalicylic acid, 4-β-p-cumyloxyethoxysalicylic acid, 4-β-(2,6-dimethylphenoxy)ethoxysalicylic acid, 4-β-(3,5-dimethoxyphenoxy)ethoxysalicylic acid, 4-β-(3,5-dimethylphenoxy)ethoxysalicylic acid, 5-β-p-ethylphenoxyethoxysalicylic acid, 4-β-phenoxyethoxy-6-methylsalicylic acid, 5-β-phenoxyethoxy-3-hydroxy-2-naphthoic acid, 7-β-phenoxyethoxy-3-hydroxy-2-naphthoic acid, 7-dodecyloxy-3-hydroxy-2-naphthoic acid, 3-(2'-hydroxyphenyl)salicylic acid, 3-(2'-benzyloxyphenyl)salicylic acid, 4-dodecyloxysalicylic acid, 4-tetradecyloxysalicylic acid, 4-pentadecyloxysalicycic acid, 4-hexadecyloxysalicylic acid, 4-octadecyloxysalicylic acid, 4-eicosyloxysalicylic acid, 4-triacontyloxysalicylic acid, 4-oleyloxysalicylic acid, 4-pentadecylsalicylic acid, 5-octadecylsalicylic acid, 5-stearoylsalicylic acid, 5-hexadecylsalicylic acid, 5-pentadecanoylsalicylic acid, 4-β-dodecyloxyethoxysalicylic acid, 4-(12-chlorododecyl)oxysalicylic acid, 4-β-N-stearoylaminoethoxysalicylic acid, 4-β-N-myristoylaminoethoxysalicylic acid, 4-β-perfluorohexylethoxysalicylic acid, 4-stearoylaminosalicylic acid, 4-p-phenylphenoxysalicyclic acid, 4-p-N-myristoylcarbamoylphenyloxysalicyclic acid, 4-p-dodecyloxyphenyloxysalicylic acid, 4-anilinocarbonylaminosalicylic acid, 3-cumyl 5-methylsalicylic acid, and so on.

$$(R_{71})_2Zn(A')_2 \qquad \text{(VII)}$$

In the above formula, $R_{71}$ represents a monodentate or polydentate colorless organic ligand to form a complex by connecting to the zinc ion via its hetero atom, and A' represents SCN, Cl or a benzoic acid anion containing an electron attracting group.

Of the colorless organic ligands represented by $R_{71}$, pyridine, imidazole, quinoline, benzothiazole, benzimidazole and antipyrine ligands are preferred. These each may be substituted with an alkyl, cyano, alkoxy, phenyl, amino, formyl, vinyl or like group. As specific examples of such compounds of formula (VII), mention may be made of those prepared from zinc rhodanide and imidazole, 2-phenylimidazole, picoline, pyridine, 2-benzylimidazole, benzoimidazole, 2,3 dimethyl-1-phenyl-3-pyrazoline-5-one, 1-phenyl-2-methyl-3-benzyl-3-pyrazoline-5-one, 1-phenyl-2-methyl-3-(2-ethylhexyl)-3-pyrazoiline-5-one, 1-phenyl-2-methyl-3-isopropyl-3-pyrazoline-5-one, 1-phenyl-2,3-dibenzylpyrazoline-5-one, 1-phenyl-2-benzyl-3-methyl-pyrazoline-5-one, and so on.

These electron-accepting compounds are used alone or as a mixture of two or more thereof.

In the heat-sensitive recording material prepared in accordance with the present invention, the heat-sensitive color forming layer can contain a heat fusible substance in order to improve heat response performance.

The heat fusible substance which can be used preferably includes compounds represented by the following formulae (IX) to (XII):

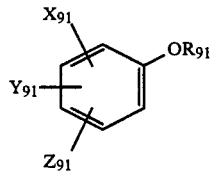

(IX)

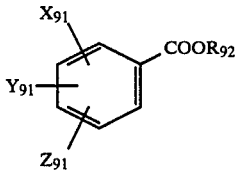

(X)

$R_{93}CONHR_{94}$ (XI)

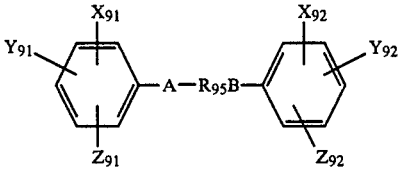

(XII)

wherein $R_{91}$, $R_{92}$ and $R_{93}$ each represents an alkyl group, or an aryl group; $R_{94}$ represents a hydrogen atom, an alkyl group, or an aryl group; $R_{95}$ represents a divalent group; A and B, which may be the same or different, each represents O, $O_2$, or S; and $X_{91}$, $Y_{91}$, $Z_{91}$, $X_{92}$, $Y_{92}$ and Z92, which may be the same or different, each represents a hydrogen atom, an alkyl group, an aryl group, an alkoxy group, a halogen atom, an alkyloxycarbonyl group, an acyloxy group or an alkylthio group, or $X_{91}$ and $Y_{91}$, or $X_{92}$ and $Y_{92}$ may combine with each other to form a ring.

The alkyl groups which can be present in formula (IX) to (XII) includes saturated, unsaturated, and cyclic ones. These groups each may have a substituent group, such as an aryl group, an alkoxy group, an aryloxy group, a halogen atom, an acylamino group, an aminocarbonyl group, a cyano group, or so on. The aryl group which can be present in formulae (IX) to (XII) includes phenyl, naphthyl and aromatic heterocyclic ones, which may have a substituent group, such as an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, or so on.

Of the substituent groups represented by $R_{91}$, $R_{92}$, $R_{93}$ and $R_{94}$, alkyl groups having 1 to 20 carbon atoms and aryl groups having 6 to 20 carbon atoms, which each may have a substituent group, are preferred over others. Suitable examples of substituent groups for the alkyl and the aryl groups include aryl groups, alkyl groups, alkoxy groups, aryloxy groups, halogen atoms, and so on. Of the divalent groups represented by $R_{95}$, alkylene groups, alkylene groups containing an ether linkage, alkylene groups containing a carbonyl group, alkylene groups containing a halogen atom, and alkylene groups containing a unsaturated bond, especially alkylene groups and alkylene groups containing an ether linkage, are preferred over others.

Among the compounds represented by formulae (IX) to (XII), it is desirable to use those having a melting point within the range of 70° C. to 150° C., more preferably 80° C. to 130° C.

Specific examples of such heat fusible substances include benzyl p-benzyloxybenzoate, β-naphthyl benzyl ether, phenyl ester of β-naphthoic acid, phenyl ester of 1-hydroxy-2-naphthoic acid, β-naphthol p-chlorobenzyl ether, β-naphthol p-methylbenzyl ether, α-naphthyl benzyl ether, 1,4-butanediol p-methylphenyl ether, 1,4-butanediol p-isopropylphenyl ether, 1,4-butanediol p-t-octylphenyl ether, 2-phenoxy-1-p-tolyloxyethane, 1-phenoxy-2-(4-ethylphenoxy)ethane, 1-phenoxy-2-(4-chlorophenoxy)ethane, 1,4-butanediol diphenyl ether, (4,4'-methoxyphenylthio)ethane, p-methoxyphenyl ester of benzoic acid, p-chlorophenyl ester of benzoic acid, dibenzyl ester of terephthalic acid, β-p-phenylphenoxyethyl ester of benzoic acid, p-chlorophenyl ester of phenoxyacetic acid, p-methylphenyl ester of phenoxyacetic acid, β-naphthyl ester of phenoxyacetic acid, N-benzylbenzamide, N-octadecylbenzamide, N-benzylphenylacetamide, N-phenylstearic acid amide, stearic acid amide, and so on.

The heat-fusible substance is preferably used in a proportion of 10 to 100 wt %, more preferably 50 to 500. wt %, to an electron-donating colorless dye.

The compound to be used in the present invention, which is represented by formula (I), is used in the form of dispersion prepared by grinding it to fine particles measuring 5 μm or less, preferably 3 μm or less, in diameter in a dispersion medium using a grinder, a dispersing machine or the like. Further, when an electron-donating colorless dye and/or an electronaccepting compound are dispersed in a dispersion medium by means of a ball mill, a sand mill or the like, the compound of the formula (I) may be added to the dispersion medium at the same time.

In particular, the simultaneous dispersal of the compound of formula (I) and the colorless dye has an advantage in that the resulting dispersion causes less coloration, while the simultaneous dispersal thereof with the electron-accepting compound has an advantage in that an increase in sensitivity can be readily gained.

In forming a recording layer, an electron-donating colorless dye and an electron-accepting compound are used in such a condition that they are ground in a dispersion medium to fine particles measuring 3 μm or less, preferably 2 μm or less, in diameter. As the dispersion medium, an aqueous solution containing a water-soluble high polymer in a concentration of 0.2 to 5% (w/v) is generally employed, and the dispersal procedure is performed using a ball mill, a sand mill, an Attritor, a colloid mill, and so on.

The electron-donating colorless dye is incorporated in the recording layer in an amount of 0.1 to 0.8 g, preferably 0.2 to 0.5 g, per square meter. A preferred ratio of the electron-donating colorless dye used to the electron-accepting compound used ranges from 1/10 to 1/1, preferably from 1/5 to ⅔, by weight. The compound represented by formula (I) in the present invention is added in a proportion of 20 to 300%, particularly 40 to 150%, by weight to the electron-accepting compound.

To a coating composition obtained by mixing the thus prepared dispersions in an appropriate ratio, certain additives are further added in order to satisfy various requirements.

For example, an oil absorbing substance, such as an inorganic pigment, etc., is dispersed in advance in the coating composition for the purpose of preventing the recording head from being stained upon recording. In addition, fatty acids, metallic soaps and the like are added for the purpose of easing the release of the heat-sensitive paper from the recording head. In general, not only the components responsible for color development, i.e., the colorless dye and electron-accepting compound, but also the specified nickel compound of the present invention (i.e., compound represented by formula (I)), the foregoing heat fusible substances, and additives including pigments, waxes, an antistatic agent, a surface active agent and so on are coated on a support to constitute a heat-sensitive recording material.

More specifically, the pigments to be added are selected from among kaolin, calcined kaolin, talc, zinc white, diatomaceous earth, calcium carbonate, aluminium hydroxide, magnesium hydroxide, magnesium carbonate, titanium oxide, barium carbonate, barium sulfate, calcined plaster, urea-formaldehyde filler, plaster, cellulose filler and so on.

As examples of the waxes, mention may be made of paraffin wax, carnauba wax, microcrystalline wax, polyethylene wax, higher fatty acid esters, and so on.

As examples of the metallic soap, mention may be made of metal slats of higher fatty acids, such as zinc stearate, aluminium stearate, calcium stearate, zinc oleate, and so on.

These additives are dispersed into a binder, and coated. As for the binder, water-soluble ones are generally used. Specific examples thereof include polyvinyl alcohol, hydroxyethyl cellulose, hydroxypropyl cellulose, ammonium salt of ethylene-maleic anhydride copolymers, styrene-maleic anhydride copolymers, isobutylene-maleic anhydride copolymers, polyacrylic acid, arylamide copolymers, denatured polyacrylic acid amides, starch derivatives, casein, gelatin and so on. To these binders can be added a gelling agent or a cross-linking agent, and an emulsion of a hydrophobic polymer such as styrene-butadiene rubber latex, acrylic resin emulsion, etc., in order to impart a water resistant property.

Further, a protective layer comprising polyvinyl alcohol or methylol-acrylamide copolymer, and methylolmelanine, boric acid, etc. can be provided.

The coating composition is most generally coated on a smooth support about 5 to 250 μm thick, preferably neutralized paper, and subjected to a calender finish.

Examples of coating methods which can be generally used in the present invention include an air knife coating method, a blade coating method, a curtain coating method, and so on.

The general coverage of the coating composition ranges frOm 2 to 10 g/m² on a solids basis. The lower limit thereof depends on the color density attainable by heat development, while the upper limit depends mainly on the economical restriction.

The present invention is illustrated in greater detail by reference to the following example. However, the inention should not be construed as being limited to this example.

EXAMPLE

A mixture of 2.0 g of 2-anilino-3-chloro-6-diethylaminofluoran and 3.5 g of 2-anilino-3-methyl-6-N-methyl-N-isoamylaminofluoran (as electron-donating colorless dyes), and 3.5 g of [2,2'-thiobis(4 t-octylphenolato)]n-butylamine nickel(II) were dispersed into 55 g portions of a 5% (w/v) aqueous solution of polyvinyl alcohol (saponification degree: 99%, polymerization degree: 1,000) using a sand mill. Separately, 10 g of bisphenol A (as an electron-accepting compound) and 5 g of 1-phenoxy-2-p-ethylphenoxyethane were dispersed into 100 g of a 5% (w/v) aqueous solution of polyvinyl alcohol using a sand mill.

After the thus prepared dispersions were mixed, 20 g of Georgia kaolin were added thereto, and thoroughly dispersed thereinto. Further, 3.5 g of a 50% (w/v) dispersion of paraffin wax emulsion (Cellosole #428, produced by Chukyo Yushi Co., Ltd.) was added thereto to prepare a coating composition.

The coating composition was coated on neutralized paper having a basis weight of 50 g/m² at a coverage of 5.8 g/m² on a solids basis, dried at 60° C. for one minute, and subjected to a supercalendering process under a linear pressure of 68 kg W/cm to produce a recording material.

Heat was applied to the recording material using a high-speed facsimile FF-2000, produced by Fujitsu Ltd., to develop a color. The density of the developed color was 1.00 upon measurement with a Macbeth densitometer RD-918.

The developed color image was exposed for 10 hours by means of a fluorescent lamp of 32,000 lux in order to examine its atness to light.

As the result, no change in color and no discoloration were observed.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material which comprises:

(I) an electron-donating colorless dye, (2) an electron-donating compound, and (3) a nickel compound represented by formula (I):

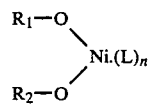

(I)

wherein $R_1$ and $R_2$ are linked with each other to form a group represented by formula (II):

(II)

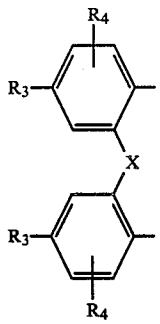

wherein $R_3$ and $R_4$ each represents a hydrogen atom, an alkyl group, an alkoxy group, an aryl group, a halogen atom, a cyano group, or a nitro group; and X represents $—SO_m—$, $—CHR_5$, or —CO—, wherein $R_5$ represents a hydrogen atom or an alkyl group and m represents 0, 1, 2; L represents an organic ligand which forms a complex salt by connecting to the nickel ion via its hetero atom; and n represents an integer of 0, 1 or 2.

2. The heat-sensitive recording material as claimed in claim 1, wherein $R_1$ and $R_2$ each represents

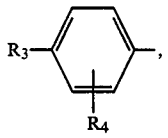

wherein $R_3$ and $R_4$ each represent a hydrogen atom, an alkyl group, an alkoxy group, an aryl group, a halogen atom, a cyano group or a nitro group.

3. The heat-sensitive recording material as claimed in claim 2, wherein $R_3$ and $R_4$ represent a hydrogen atom, an alkyl group having 1 to 12 carbon atoms, an alkoxy group having 1 to 10 carbon atoms, a phenyl group or a chlorine atom.

4. The heat-sensitive recording material as claimed in claim 1, wherein said nickel compound is used in an amount of 5 to 200 wt % to the electron-donating colorless dye.

5. The heat-sensitive recording material as claimed in claim 1, wherein said electron-donating colorless dye is incorporated in a recording layer in an amount of 0.1 to 0.8 g per square meter.

6. The heat-sensitive recording material as claimed in claim 1, wherein the ratio of electron-donating colorless dye to electron-accepting compound is in the range of 1/10 to 1/1 by weight.

* * * * *

UNITED STATES PATENT AND TRADEMARK OFFICE

CERTIFICATE OF CORRECTION

PATENT NO. : 4,871,713

DATED : October 3, 1989

INVENTOR(S) : Katsumi Matsuoka, Kensuke Ikeda and Ken Iwakura

It is certified that error appears in the above-identified patent and that said Letters Patent is hereby corrected as shown below:

On the title page:

In the foreign application priority data, please delete "67-57832" and insert --62-57832--.

In item [*] (Notice), please delete "Dec. 5, 1988".

Signed and Sealed this

Twenty-third Day of October, 1990

*Attest:*

HARRY F. MANBECK, JR.

*Attesting Officer*

*Commissioner of Patents and Trademarks*